United States Patent [19]

Gibson

[11] 4,008,986

[45] Feb. 22, 1977

[54] CORNER SEAL FOR ROTARY MECHANISMS

[75] Inventor: Myron R. Gibson, Edelstein, Ill.

[73] Assignee: Caterpillar Tractor Co., Peoria, Ill.

[22] Filed: Dec. 22, 1975

[21] Appl. No.: 643,431

[52] U.S. Cl. ..... 418/51; 418/121; 418/142

[51] Int. Cl.[2] ..... F01C 19/08; F04C 27/00; F01C 1/02

[58] Field of Search ..... 418/113, 120–124, 418/142, 51

[56] References Cited

UNITED STATES PATENTS

| | | | |
|---|---|---|---|
| 3,180,560 | 4/1965 | Paschke | 418/142 |
| 3,180,562 | 4/1965 | Bentele | 418/142 |
| 3,326,454 | 6/1967 | Castelet | 418/123 |
| 3,881,848 | 5/1975 | Huf | 418/123 |

FOREIGN PATENTS OR APPLICATIONS

| | | | |
|---|---|---|---|
| 1,196,452 | 7/1965 | Germany | 418/122 |

*Primary Examiner*—John J. Vrablik
*Attorney, Agent, or Firm*—Wegner, Stellman, McCord, Wiles & Wood

[57] ABSTRACT

An improved corner seal for rotary mechanisms, such as trochoidal or slant axis rotary mechanisms. The mechanism includes a housing defining a chamber with a rotor movable therein. The rotor includes a piston seal receiving bore and a piston seal is received in the bore and sealingly engages one wall of the chamber. An apex seal receiving groove is located in the rotor and intersects the bore. An apex seal is received in the groove and sealingly engages another wall of the chamber. A ring-like expander seal is within the bore and sealingly engages the piston seal and the bore when gas under pressure is directed to the bore from the groove.

9 Claims, 7 Drawing Figures

CORNER SEAL FOR ROTARY MECHANISMS

BACKGROUND OF THE INVENTION

This invention relates to rotary mechanisms, such as pumps, compressors, engines, or the like, and, more specifically, to corner seals employed in such mechanisms.

Conventional corner seals in trochoidal engines and slant axis rotary engines are expensive to manufacture. Typically, the corner seals include so-called "piston seals" (sometimes termed bolts) which are disposed at the intersection of apex seals and end seals in trochoidal type mechanisms or peripheral seals in slant axis rotary mechanisms. Usually, the piston seals are provided with at least two grooves, one for receipt of the apex seal and one for receipt of the end or peripheral seal. To achieve adequate sealing, the centerline of the grooves in the piston seal must accurately align with the corresponding seal receiving grooves in the rotor and such centerlines preferably should coincide with the center of the piston seal.

Since the design or typical clearance between seals and the sides of the grooves is normally on the order of 0.08 mm, tolerances must be held quite close to prevent excessive leakage that would have a detrimental effect on mechanism performance. As a consequence, manufacturing cost is undesirably high.

SUMMARY OF THE INVENTION

It is the principal object of the invention to provide a new and improved rotary mechanism. More specifically, it is an object of the invention to provide a new and improved corner seal configuration for use in such mechanisms.

An exemplary embodiment of the invention achieves the foregoing object in a rotary mechanism having a housing defining a chamber with a rotor movable within the chamber. A piston seal receiving bore is placed in the rotor and a piston seal is received in the bore to be carried by the rotor and to sealingly engage a wall of the chamber. An apex seal receiving groove is disposed in the rotor and intersects the bore. The groove receives an apex seal to be carried by the rotor and which sealingly engages another wall of the chamber. A ring-like expander seal is disposed within the bore for sealingly engaging both the piston seal and the sides of the bore when gas under pressure is directed to the bore from the groove. As a consequence, diametral tolerances in the formation of the bore may be somewhat relaxed to minimize manufacturing expenses without the creation of a path for excessive leakage since any such path will be sealed by the expander seal.

In a preferred embodiment of the invention, a spacer is disposed within the bore and engages the expander seal oppositely of the piston seal. A spring is disposed in the bore for resiliently urging the spacer against the expander seal and thus urging the piston seal into sealing engagement with the one wall of the chamber.

In one embodiment, the spacer includes a central body which is engaged by the spring and a plurality of radially outwardly extending tabs which engage the expander seal.

According to a highly preferred embodiment of the invention, the expander seal includes a relatively thick head sealingly engaging the piston seal and a relatively thin skirt sealingly engaging the bore to maximize its response to gas under pressure.

The expander seal may be slotted. When such is the case, the slot will usually be aligned with the apex seal receiving groove and the slot will have a width sufficient to receive the apex seal.

According to a further embodiment of the invention, the rotor includes a further seal receiving groove for receiving an end seal in a trochoidal mechanism or a peripheral seal in a slant axis rotary mechanism. The further seal receiving groove intersects the bore at an angle to the apex seal receiving groove. A peripheral or end seal is disposed within the grooves in the piston and the rotor and sealingly engages the same wall as that engaged by the piston seal.

Preferably, the groove in the piston seal receiving the end or peripheral seal opens to the expander seal and the end or peripheral seal is dimensioned to be nearly contacted by the expander seal.

Other objects and advantages will become apparent from the following specification taken in connection with the accompanying drawings.

DESCRIPTION OF THE PREFERRED EMBODIMENT

Figure 1:
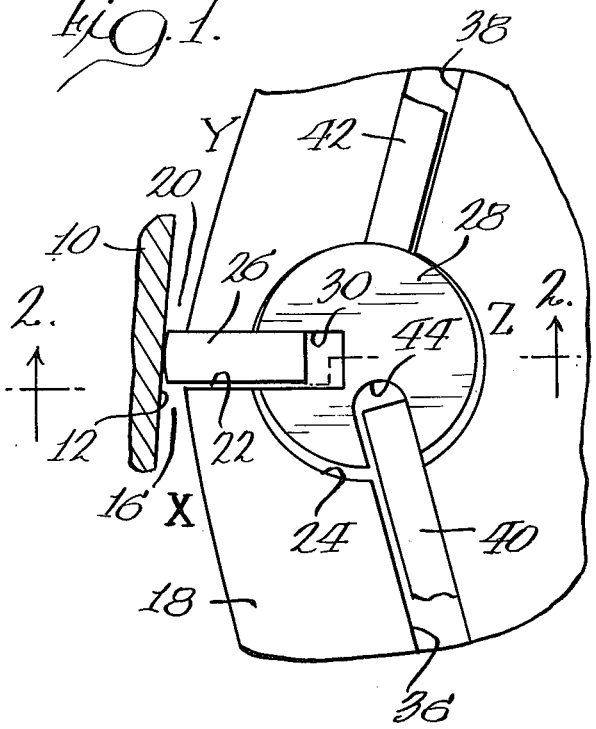
FIG. 1 is a fragmentary view of a portion of a rotary mechanism embodying a corner seal made according to the invention.
Figure 2:
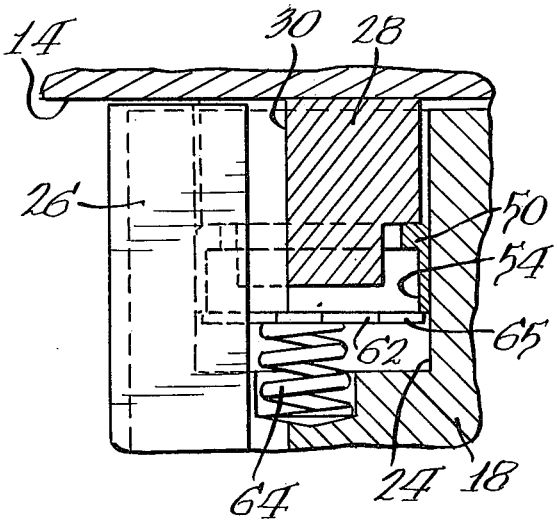
FIG. 2 is a sectional view taken approximately along the line 2—2 of FIG. 1.

An exemplary embodiment of a corner seal made according to the invention is illustrated in FIGS. 1 and 2 in connection with a fragmentary, somewhat schematic showing of a slant axis rotary mechanism. However, it is to be understood that the invention is not limited to slant axis rotary mechanisms but may be employed in any rotary mechanism employing corner seals as, for example, trochoidal mechanisms. It is also to be understood that the invention is not limited to any particular type of such mechanisms, it being apparent to those skilled in the art that the same has utility in such mechanisms whether used as engines, pumps, compressors, or the like.

The mechanism includes a housing 10 having wall 12 which, in connection with a wall 14 (FIG. 2), defines a chamber 16. Disposed within the chamber is a rotor 18 having plural apices 20 (only one of which is shown). Each of the apices 20 is provided with an apex seal receiving groove 22 which intersects a piston seal receiving bore 24. An apex seal 26 is disposed within the apex seal receiving groove 24 while a piston seal 28 is disposed within the bore 24. As can be seen in FIGS. 1 and 2, the apex seal 26 sealingly engages the wall 12, while the piston seal sealingly engages the wall 14.

Figure 3:
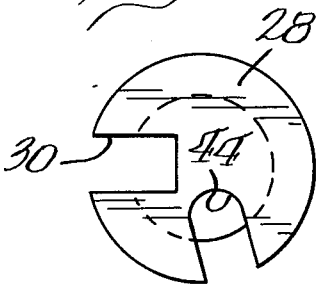
FIG. 3 is a plan view of a piston seal employed in the invention.
Figure 4:
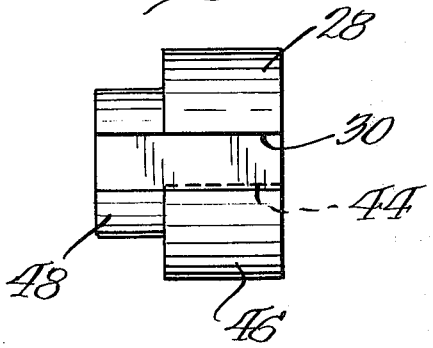
FIG. 4 is a side view of the piston seal.

As seen in FIGS. 1, 3 and 4, the piston seal 28 is provided with an apex seal receiving groove 30 which receives one end of the apex seal 26 as illustrated in FIG. 2. The groove 30 will have a width slightly greater than that of the apex seal 26 so as to provide for gas energization of the apex seal 26 in a customary fashion. As a result of this configuration, it will be appreciated that the apex seal receiving groove 22 in the rotor intersects the bore 24.

The rotor 18 is provided with additional seal receiving grooves 36 and 38 for receipt of seals 40 and 42, respectively, which sealingly engage the wall 14 as is well known. If the mechanism is a slant axis rotary mechanism as depicted, the seals 40 and 42 will be so-called "peripheral seals", while if the mechanism is a trochoidal mechanism, the seals 40 and 42 will be so-called "end seals".

A groove 44, alignable with the groove 36, is located in the piston seal 28 and, as seen in FIGS. 3 and 4, extends through an enlarged diameter portion 46 thereof to a shoulder defined by enlarged diameter portion 46 and a reduced diameter portion 48. The purpose of this configuration will be described in greater detail hereinafter.

Figure 5:
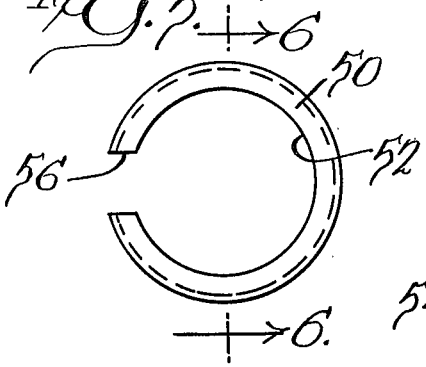
FIG. 5 is a plan view of an expander seal employed in the mechanism.
Figure 6:
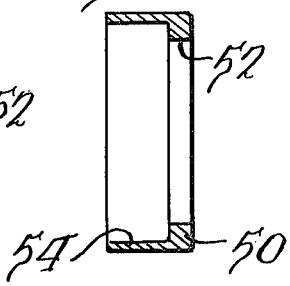
FIG. 6 is a sectional view taken approximately along the line 6—6 of FIG. 5.
Figure 7:
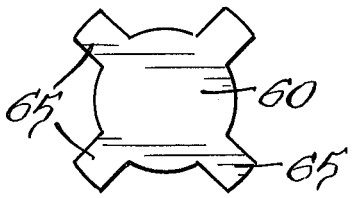
FIG. 7 is a plan view of a spacer utilized in the mechanism.

Turning to FIGS. 2, 5 and 6, it will be seen that the corner seal configuration of the present invention includes an expander seal 50. As seen in FIG. 6, the expander seal 50 includes a relatively thick head 52 and a relatively thin skirt 54. As seen in FIG. 5, the same includes a slot 56 and the slot 56 is of a width just slightly greater than that of the apex seal 26.

As seen in FIG. 2, the expander seal 50 is disposed within bore 24 with the head 52 in sealing engagement with the shoulder on the underside of the enlarged diameter portion 46 of the piston seal 28. The apex seal 26 is received in the slot 56. A spacer 60 abuts the expander seal 50 oppositely of the piston seal 28 and includes a central body 62 which is engaged by a biasing spring 64 disposed within the bore 24. The biasing spring 64 ultimately biases the piston seal 28 into sealing engagement with the wall 14.

The central body 62 of the spacer 60 includes a plurality of radially outwardly extending tabs 65 which engage the skirt 54 of the expander seal 50 to bias the same upwardly into sealing engagement with the underside of the piston seal 28 and provide the aforementioned biasing of the piston seal 28 against the wall 14.

Returning to the seal 40 and the groove 44, it is preferred that the seal 40 be dimensioned so that, when in engagement with the wall 14, it will be very nearly engaged by the head 52 of the expander seal 50.

With reference to FIGS. 1 and 2, the operation of the corner seal configuration of the present invention will be described. If the pressure in the area X is greater than that in either area Y or Z, apex seal 26 will be driven against the upper surface of the groove 22 as illustrated in FIG. 1 and the gas under pressure may pass between the apex seal 26 and the lower wall of the groove 22 to gas energize the apex seal 26 in a conventional fashion. When the gas reaches the bottom of the groove 22, a certain amount of the same will be permitted to pass to the interior of the expander seal 50 within the bore 24 to act against the skirt 54 thereof and drive the same into good sealing engagement with the walls of the bore 24. At the same time, gas under pressure will act against the underside of the head 52 as well as the bottom of the skirt 54 to drive the expander seal 50 upwardly into good sealing engagement with the underside of the step on the piston seal 28. Thus, diametral tolerances between the piston seal 28 and the bore 24 may be relaxed as shown in somewhat exaggerated form in FIG. 1 and yet no substantial leakage path will occur. The use of the relatively thin skirt 52 on the expander seal insures that the same will readily respond to gas under pressure. In addition, if desired, the expander seal 50 may be formed of a resilient material and in such a way that it must be slightly compressed to be disposed within the bore 24. Thus, in such a situation, it will be somewhat pre-loaded into sealing engagement with the side walls of the bore 24.

Finally, by dimensioning the seal 40 so as to be very nearly contacted by the expander seal, as mentioned previously, leakage is further minimized.

From the foregoing, it will be appreciated that a corner seal configuration made according to the invention eliminates the need for close manufacturing tolerances in the formation of the piston seal receiving bore and the piston seal, thereby maximizing efficiency of the mechanism in which such configurations are employed.

What is claimed is:

1. In a rotary mechanism having a housing defining a chamber with a rotor movable therein, the combination of:

a piston seal receiving bore in said rotor;

a piston seal received in said bore to be carried by said rotor and sealingly engaging one wall of said chamber, said piston seal being stepped along its length to provide a shoulder within said bore;

an apex seal receiving groove in said rotor and intersecting said bore;

an apex seal received in said groove to be carried by said rotor and sealingly engaging another wall of said chamber; and a ring-like expander seal within said bore sealingly engaging said shoulder on said piston seal and said bore when gas under pressure is directed to said bore from said groove.

2. The rotary mechanism of claim 1 wherein said piston seal includes an enlarged diameter portion and a reduced diameter portion, and said shoulder is generally annular and at the interface of said portions.

3. The rotary mechanism of claim 1 wherein said expander seal includes a relatively thick head sealingly engaging said shoulder and a relatively thin skirt depending from said head and sealingly engaging said bore.

4. The rotary mechanism of claim 3 wherein said expander seal is slotted.

5. The rotary mechanism of claim 3 wherein said expander seal includes a slot aligned with said groove, said slot having a width sufficient to receive said apex seal.

6. The rotary mechanism of claim 3 wherein said rotor includes a further seal receiving groove intersecting said bore at an angle to said apex seal receiving groove, and said piston seal includes a further seal receiving groove aligned with said rotor further seal receiving groove, and an elongated seal received in said further seal receiving grooves and sealingly engaging said one wall.

7. In a rotary mechanism having a housing defining a chamber with a rotor movable therein, the combination of:

a piston seal receiving bore in said rotor;

a piston seal received in said bore to be carried by said rotor and sealingly engaging one wall of said chamber;

an apex seal receiving groove in said rotor and intersecting said bore;

an apex seal received in said groove to be carried by said rotor and sealingly engaging another wall of said chamber;

a ring-like expander seal within said bore for sealingly engaging said piston seal and said bore when gas under pressure is directed to said bore from said groove;

a spacer within said bore and engaging said expander seal oppositely of said piston seal; and spring means resiliently urging said spacer against said expander seal.

8. The rotary mechanism of claim 7 wherein said spacer includes a central body engaged by said spring means and a plurality of radially outwardly extending tabs engaging said expander seal.

9. The rotary mechanism of claim 7 wherein said expander seal includes a relatively thick head sealingly engaging said piston seal and a relatively thin skirt sealingly engaging said bore.

* * * * *